United States Patent [19]

Weinert

[11] Patent Number: 4,480,650

[45] Date of Patent: Nov. 6, 1984

[54] COATED SELF-EXTINGUISHED CIGARETTE

[76] Inventor: Friedrich Weinert, 219-19-131st Ave., Jamaica, N.Y. 11413

[21] Appl. No.: 353,963

[22] Filed: Mar. 2, 1982

[51] Int. Cl.[3] ..... A24D 1/02; A24D 1/04

[52] U.S. Cl. ..... 131/349; 131/365

[58] Field of Search ..... 131/94, 349, 362, 365

[56] References Cited

FOREIGN PATENT DOCUMENTS 863398 3/1961 United Kingdom ..... 131/349

*Primary Examiner*—V. Millin

[57] ABSTRACT

Cigarette coating comprises a fireproof coating made from clay or ceramic applied on the inside of the cigarette paper divided in sections to prevent glowing tobacco from penetrating to the outside but allows air circulation through cracks created when heat makes contact with the coating.

1 Claim, 3 Drawing Figures

COATED SELF-EXTINGUISHED CIGARETTE

This invention introduces a fireproof coating for cigarettes which hardens, brittles and chips off from the cigarette after the glowing tobacco moves further inward or the coating is divided in sections to flip off from the cigarette after the glowing tobacco moved beyond that section. The purpose of this invention is to reduce fire hazards created when glowing tobacco is exposed to the outside of the cigarette making contact with flammable material.

BACKGROUND OF THE INVENTION

The present invention reduces drastically the fire hazards by a simple process in the form of clay which is applied on the inside of cigarette paper. When the cigarette is lit the heat of the glowing tobacco will brittle the clay coating enough to allow air to penetrate but prevent glowing tobacco in the combination zone to be exposed to the outside. In order to separate the ashes from the cigarette the clay coating is divided in sections. This allows the cigarette paper to burn off in between the sections. The burned out sections will fall off from the cigarette with no danger. It is also recommended to put a sleeve or a collar around the last section of the cigarette or filter. This will conceal the last burning section of the cigarette which is often thrown away by a careless smoker.

SUMMARY OF THE INVENTION

In accordance with the invention, there is provided a fireproof coating to eliminate fire hazards. Additionally, the quality of tobacco smoking is improved by eliminating gases produced by the burning of the cigarette paper which contains toxic carbon monoxide. Cigarette paper is usually manufactured and prepared in large quantities, meaning large rolls are connected in such a manner so that one surface can be printed with a trade mark for each cigarette. During this process, the outer side of the paper can be sprayed with a liquid clay or ceramic which will dry quickly. This coating makes the cigarette paper fire proof, meaning the glowing tobacco cannot penetrate through the cigarette paper. Ordinary cigarette paper will burn faster than the tobacco and therefore the burning ashes from the tobacco will extend to the outside of the cigarette. The coated paper will not burn, but break off after the tobacco is burned into ashes, meaning the tobacco burns faster than the coated cigarette paper. Further objects of this invention will be pointed out in the following detailed description and claims and illustrated in the accompanying drawing which disclosed by way of example the principal of this invention and the best mode which has been contemplated of applying that principal.

DETAILED DESCRIPTION OF A PREFERRED EMBODIMENT

Figure 1:
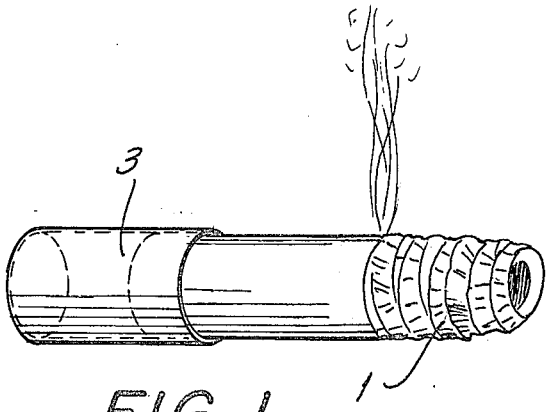
FIG. 1 is a perspective view of a burning cigarette coated on the inside with a fire proof coating which brittles and breaks off as the glowing tobacco moves further inward.

Referring to FIG. 1 there is shown a clay coated cigarette of the present invention. The coating is applied on the inside to prevent glowing tobacco to penetrate to the outside meaning during the smoking procedure the heat of the tobacco will brittle and crack the cigarette paper (1) allowing air to penetrate into the cigarette but preventing the glowing tobacco from exposing to the outside.

Figure 2:
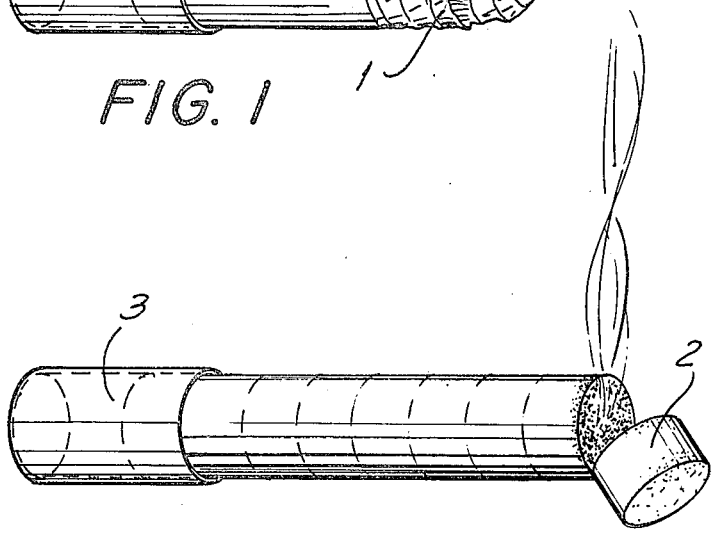
FIG. 2 is a perspective view of a burning cigarette coated in sections to separate the ashes in sections.
Figure 3:
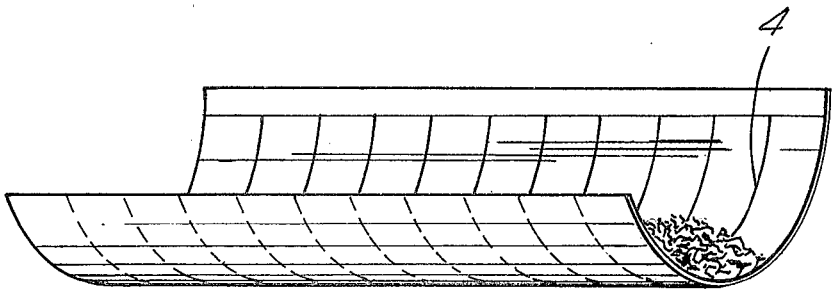
FIG. 3 is a perspective view to show the pattern of the cigarette inside the cigarette paper.

The disadvantage of this design is that during smoking a long tip of ashes is formed at the front of the cigarette which is removed by the flip of a finger. To improve the procedure FIG. 2 shows the separation of the ashes in sections (2) which means the coating inside the cigarette paper is divided in sections as shown in FIG. 3. Additionally, the cigarette filter (3) encased the last section of the cigarette to prevent a fire hazard when discarded from a careless cigarette smoker.

FIG. 3 shows a perspective view of the inside of the cigarette paper clearly indicating the grooved lines (4) dividing the clay coating into sections. The coating on the inside does not only eliminate fire hazards but also improves the quality of the tobacco. Cigarette paper when burned emanates poison gases, which often is inhaled by the smoker. Clay or ceramic does not emanate any poison gases because it doesn't burn and therefore no chemical reaction is involved. The coating itself is a separate manufacturing process and therefore not explained in this invention.

While there have been shown and described and pointed out the fundamental features of the invention as applied to a preferred ambodiment, it will be understood that varius omissions and substitutions and changes in the form and detail of this design as illustrated in its detail may be made by those skilled in the art without departing from spirit of the invention.

I claim:

1. A cigarette comprising a charge of tobacco wrapped in a cigarette paper wherein the wrapper is coated on its inner portion that contacts said tobacco with a fire proofing clay in an effective amount so that upon the burning of the cigarette the clay becomes brittle and cracks allowing air to penetrate into the combustion zone but physically segregating the combustion zone from its ambient surroundings and wherein said clay coating is divided into annular sections so that when the cigarette is smoked the separate clay sections will individually fall off.

* * * * *